US011273644B2

(12) United States Patent
Katayama et al.

(10) Patent No.: US 11,273,644 B2
(45) Date of Patent: Mar. 15, 2022

(54) LIQUID DISCHARGE HEAD

(71) Applicant: BROTHER KOGYO KABUSHIKI KAISHA, Nagoya (JP)

(72) Inventors: Hiroshi Katayama, Toyoake (JP); Taisuke Mizuno, Yokkaichi (JP); Jiro Yamamoto, Nagoya (JP); Shotaro Kanzaki, Nagoya (JP); Keita Sugiura, Toyokawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/031,418

(22) Filed: Sep. 24, 2020

(65) Prior Publication Data

US 2021/0129533 A1 May 6, 2021

(30) Foreign Application Priority Data

Nov. 6, 2019 (JP) ..... JP2019-201701

(51) Int. Cl.
*B41J 2/14* (2006.01)
*B41J 2/145* (2006.01)

(52) U.S. Cl.
CPC ..... *B41J 2/1433* (2013.01); *B41J 2/145* (2013.01)

(58) Field of Classification Search
CPC ..... B41J 2/1433; B41J 2/145; B41J 2002/14225; B41J 2002/14419; B41J 2202/11; B41J 2202/12; B41J 2/14233; B41J 2/14209
See application file for complete search history.

(56) References Cited

U.S. PATENT DOCUMENTS

2019/0366714 A1* 12/2019 Tsukahara ..... B41J 2/175
2019/0366717 A1 12/2019 Tsukahara et al.
2021/0008881 A1 1/2021 Mizuta et al.

FOREIGN PATENT DOCUMENTS

JP 2018-103601 A 7/2018

* cited by examiner

*Primary Examiner* — Bradley W Thies
(74) *Attorney, Agent, or Firm* — Merchant & Gould P.C.

(57) ABSTRACT

There is provided a liquid discharge head including a channel unit that includes plates stacked on top of each other in a first direction and is formed having individual channels, a first common channel, and a second common channel. The first and second common channels communicate with the individual channels. Each individual channel includes a nozzle, a pressure chamber, a descender, a first throttle channel, and a second throttle channel. The plates include a nozzle plate, a pressure chamber plate, and a first plate formed having a first through hole that constitutes part of the descender. A center portion of the nozzle is positioned at a side opposite to the second throttle channel in the second direction with respect to a center portion of the descender. The descender has a protruding channel portion that is formed in the first plate, is positioned at an end at the side opposite to the second throttle channel in the second direction, and protrudes toward the side opposite to the second throttle channel beyond any other portion of the descender.

12 Claims, 6 Drawing Sheets

LIQUID DISCHARGE HEAD

CROSS REFERENCE TO RELATED APPLICATION

The present application claims priority from Japanese Patent Application No. 2019-201701 filed on Nov. 6, 2019, the disclosure of which is incorporated herein by reference in its entirety.

BACKGROUND

Field of the Invention

The present disclosure relates to a liquid discharge head configured to discharge liquid from a nozzle.

Description of the Related Art

There is known a liquid jetting head in which a pressure chamber is located above a nozzle and is connected to the nozzle by a communicating channel extending in an up-down direction. In this liquid jetting head, a lower end of the communicating channel is connected to a circulating liquid chamber through a circulation channel. The center of the nozzle is offset from the center axis of the communicating channel in a direction opposite to the circulation channel. Further, there is known a structure in which a nozzle plate and a first channel plate are joined. In this structure, the nozzle and the circulation path are formed in the nozzle plate, and the communicating channel or the like is formed in the first channel plate.

SUMMARY

In a case that the center of the nozzle is offset from the center axis of the communicating channel in the direction opposite to the circulation channel, the nozzle is located closer to an inner wall surface opposite to the circulation channel, as compared with a case in which the center of the nozzle is coincide with the center axis of the communicating channel. At the time of joining the nozzle plate and the first the channel plate, these plates may be joined to be misaligned. In such a case, there is a possibility that the nozzle is blocked by the portion, of the first channel plate, which is to be the wall of the communicating channel.

An object of the present disclosure is to provide a liquid discharge head in which the nozzle is not blocked by the plate joined to the nozzle plate, even in a case that the center of the nozzle is displaced relative to the center of a descender.

According to an aspect of the present disclosure, there is provided a liquid discharge head, including: a channel unit including: a plurality of plates stacked in a first direction. A plurality of individual channels, a first common channel communicating with the individual channels, and a second common channel communicating with the individual channels are formed in the channel unit. Each of the individual channels includes: a nozzle; a pressure chamber disposed away from the nozzle in the first direction and overlapping with the nozzle in the first direction; a descender extending in the first direction and connecting the nozzle and the pressure chamber; a first throttle channel connecting the pressure chamber and the first common channel; and a second throttle channel extending in a second direction orthogonal to the first direction and connecting the second common channel and an end of the descender at a side of the nozzle in the first direction. The plates include: a nozzle plate in which the nozzle is opened; a pressure chamber plate in which the pressure chamber is formed; and a first plate which is joined to a surface of the nozzle plate at a side of the pressure chamber plate in the first direction and in which a first through hole that constitutes part of the descender is formed. A center portion of the nozzle is positioned at a side opposite to the second throttle channel in the second direction with respect to a center portion of the descender. The descender includes a protruding channel portion that is formed in the first plate, is positioned at an end at the side opposite to the second throttle channel in the second direction, and protrudes toward the side opposite to the second throttle channel beyond any other portion of the descender.

DESCRIPTION OF THE EMBODIMENTS

An embodiment of the present disclosure is described below.

<Schematic Configuration of Printer 1>

Figure 1:
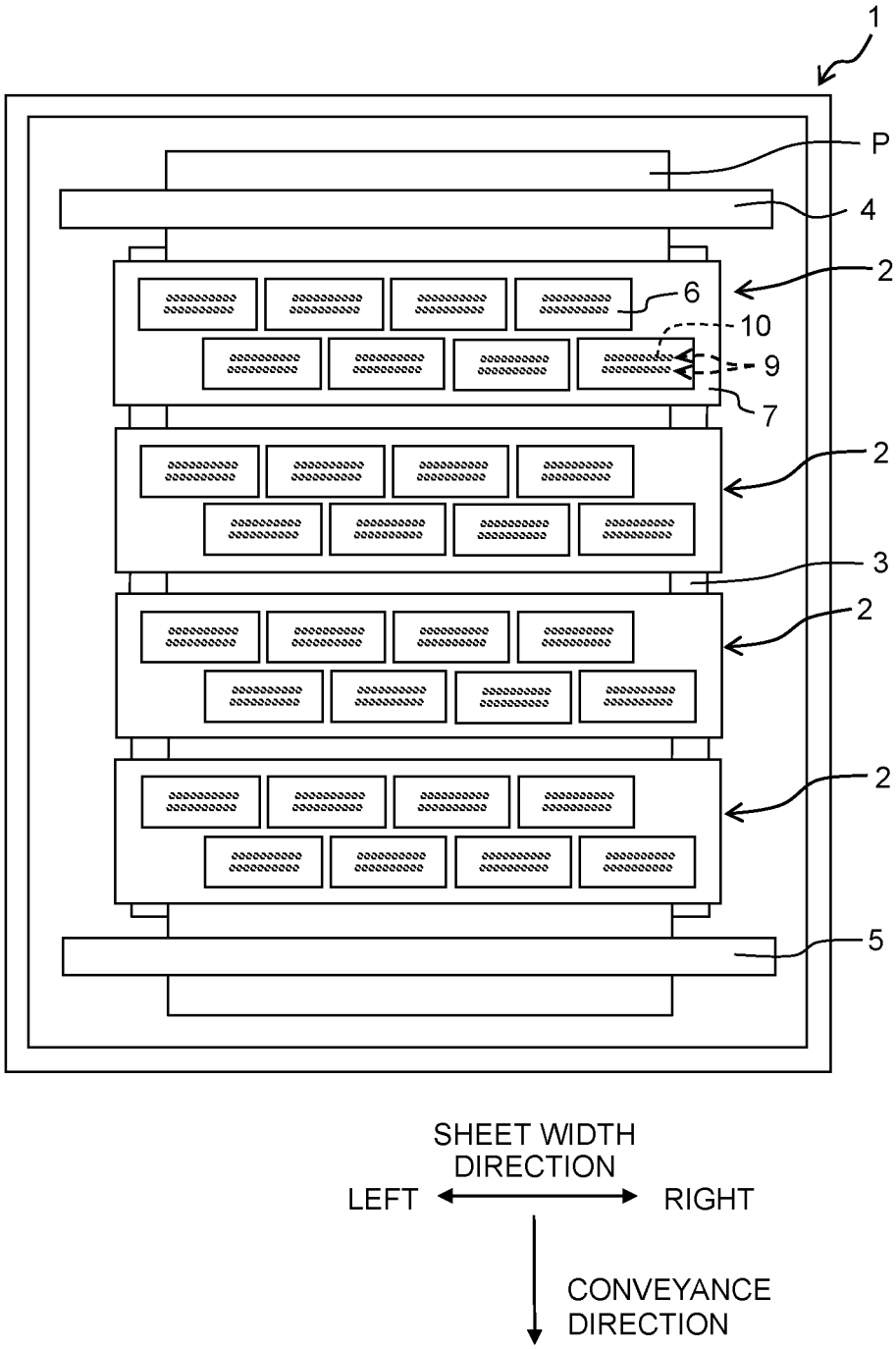
FIG. 1 schematically depicts a configuration of a printer 1.
Figure 2:
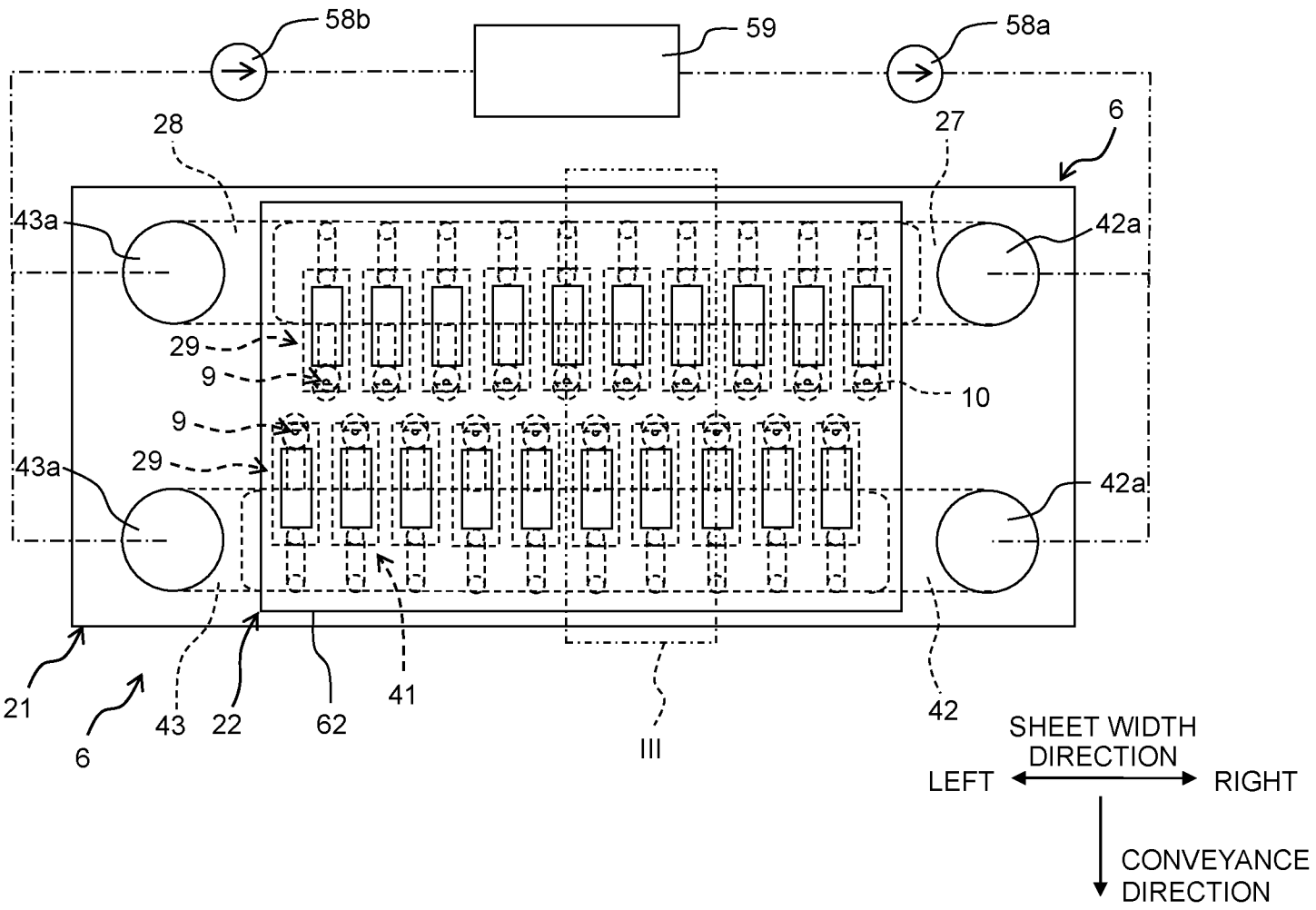
FIG. 2 is a plan view of an ink-jet head 2 in FIG. 1.

As depicted in FIG. 1, a printer 1 according to this embodiment includes four ink-jet heads 2, a platen 3, and conveying rollers 4 and 5.

The four ink-jet heads 2 are arranged side by side in a conveyance direction ("a second direction" of the present disclosure) in which a recording sheet P is conveyed. The conveyance direction is horizontal. Each ink-jet head 2 includes eight head units 6 ("a head" of the present disclosure) and a support member 7.

Each head unit 6 has nozzles 10. The nozzles 10 form a nozzle row 9 by being arranged at predefined nozzle intervals in a sheet width direction ("a third direction" of the present disclosure) that is orthogonal to the conveyance direction. The sheet width direction is horizontal. The head unit 6 includes two nozzle rows 9 arranged in the conveyance direction. The positions of the nozzles 10 belonging to one of the two nozzle rows 9 are shifted from the positions of the nozzles 10 belonging to the other by a length half of the nozzle interval in the sheet width direction.

Four head units 6 of one ink-jet head 2 form a row of head units 6 arranged in the sheet width direction. In the ink-jet head 2, two rows of head units 6 are arranged in the conveyance direction. The head units 6 forming an upstream-side row in the conveyance direction are shifted in the sheet width direction from the head units 6 forming a downstream-side row in the conveyance direction. Part of the nozzles 10 of the head units 6 forming the upstream-side row in the conveyance direction overlap in the conveyance direction with part of the nozzles 10 of the head units 6 forming the downstream-side row in the conveyance direction. The nozzles 10 of the eight head units 6 are thus arranged over an entire length of the recording sheet P in the sheet width direction. Namely, the ink-jet head 2 is a so-called line head. The support member 7 is a rectangular plate-like member that is long in the sheet width direction. The support member 7 holds the eight head units 6 in the positional relationship described above.

In each of the four ink-jet heads 2, a black ink is discharged from the nozzles 10 arranged at the most upstream side in the conveyance direction, a yellow ink is discharged from the nozzles 10 arranged at the second most upstream side in the conveyance direction, a cyan ink is discharged from the nozzles 10 arranged at the third most upstream side in the conveyance direction, and a magenta ink is discharged from the nozzles 10 arranged at the most downstream side in the conveyance direction.

The platen 3 is positioned below the four ink-jet heads 2. The platen 3 extends over the four ink-jet heads 2 in the conveyance direction and extends over an entire length of each ink-jet head 2 in the sheet width direction. During recording, the platen 3 supports the recording sheet P from below.

The conveying roller 4 is disposed upstream of the four ink-jet heads 2 and platen 3 in the conveyance direction. The conveying roller 5 is disposed downstream of the four ink-jet heads 2 and the platen 3 in the conveyance direction. The conveying rollers 4 and 5 convey the recording sheet P in the conveyance direction.

In the printer 1, an image can be recorded on the recording sheet P by discharging inks from the nozzles 10 of the four ink-jet heads 2 onto the recording sheet P while conveying the recording sheet P in the conveyance direction by use of the conveyance rollers 4 and 5.

<Head Unit 6>

Subsequently, structure of the head unit 6 is explained in detail. As depicted in FIG. 2, FIG. 3, and FIGS. 4A and 4B, the head unit 6 includes a channel unit 21 and a piezoelectric actuator 22.

In the channel unit 21, nine plates 31 to 39 are stacked on top of each other in this order from the bottom in a vertical direction ("a first direction" of the present disclosure). The plates 31 to 39 are formed, for example, by a metallic material such as SUS430. Each of the plates 31 to 39 has a thickness, for example, from 50 to 150 μm. Of the plates 31 to 39, at least the plate 32 has a thickness of equal to or less than 100 μm. In this embodiment, the plate 31 corresponds to "a nozzle plate" of the present disclosure, the plate 32 corresponds to "a first plate" of the present disclosure, the plate 33 corresponds to "a second plate" of the present disclosure, and the plate 39 corresponds to "a pressure chamber plate" of the present disclosure.

The channel unit 21 includes individual channels 41, two first common channels 42, and two second common channels 43.

Each individual channel 41 includes the nozzle 10, a pressure chamber 51, a descender 52, the first throttle channel 53, and the second throttle channel 54. The nozzle 10 is formed in the plate 31. The nozzles 10 forming the individual channels 41 form two nozzle rows 9 as described above. Each nozzle 10 is formed in a tapered shape in which a diameter is larger toward the upper side in the vertical direction. In the nozzle 10, a radius Rn1 at its lower end is, for example, about 5 μm (a diameter at its lower end is about 10 μm), and a radius Rn2 at its upper end is, for example, about 25 μm (a diameter at its upper end is about 50 μm).

The pressure chamber 51 is formed in the plate 39. The pressure chamber 51 has a rectangular planar shape that is long in the conveyance direction. An end of the pressure chamber 51 at one side in the conveyance direction overlaps with the corresponding nozzle 10 in the vertical direction. Regarding the individual channels 41 belonging to the upstream-side nozzle row 9 in the conveyance direction, one side in the conveyance direction is the downstream side in the conveyance direction. Regarding the individual channels 41 belonging to the downstream-side nozzle row 9 in the conveyance direction, one side in the conveyance direction is the upstream side in the conveyance direction. This definition of "one side in the conveyance direction" may be applied to the following explanation. Further, in the following explanation, a side opposite to "one side in the conveyance direction" may be defined as "the other side in the conveyance direction".

The descender 52 is formed by overlapping through holes 32*a* to 38*a* formed in the plates 32 to 38 in the vertical direction. The descender 52 extends in the vertical direction to connect the nozzle 10 and the pressure chamber 51. Further, a central axis An of the nozzle 10 is shifted from a central axis Ad of the descender 52 to one side in the conveyance direction. In this embodiment, the through hole 32*a* corresponds to "a first through hole" of the present disclosure, and the through hole 33*a* corresponds to "a second through hole" of the present disclosure.

Of the through holes 32*a* to 38*a* forming the descender 52, the through holes 33*a* to 38*a* have circular openings with the radius Rd of about 75 μm (with the diameter of about 150 μm). The opening of the through hole 32*a* has an oval or elliptical shape that is long in the conveyance direction, in which the length in the sheet width direction is approximately the same as that of the through holes 33*a* to 38*a* (the diameter is about 150 μm) and the length in the conveyance direction is longer than that of the through holes 33*a* to 38*a*. An end of the through hole 32*a* at the other side in the conveyance direction overlaps the through hole 33*a* to 38*a* in the vertical direction. The through hole 32*a* extends to one side in the conveyance direction beyond the through holes 33*a* to 38*a*. A lower end of the descender 52 thus has a protruding channel portion 52*a* that protrudes toward one side in the conveyance direction beyond any other portion.

Figure 4A:
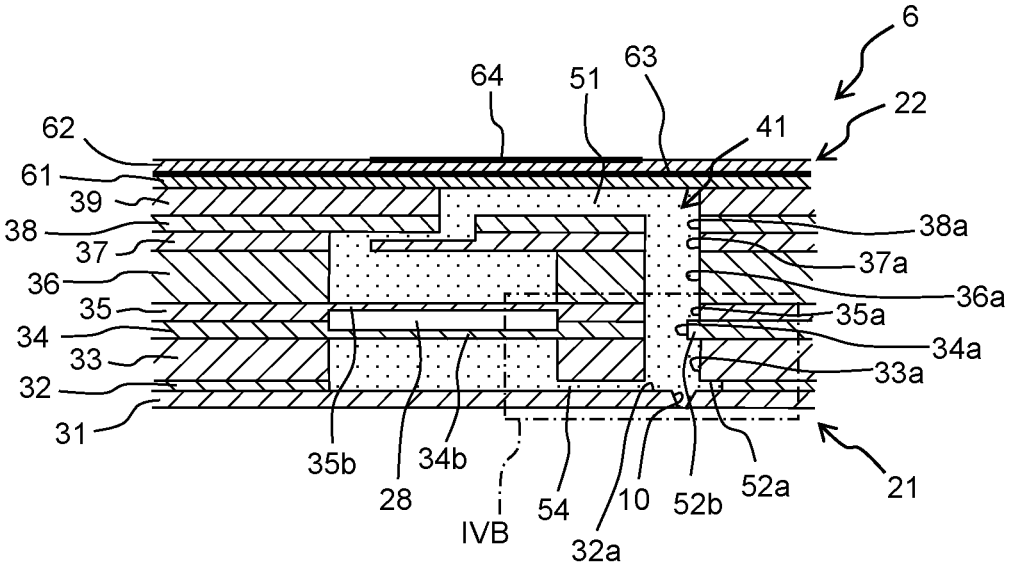
FIG. 4A is a cross-sectional view taken along a line IVA-IVA in FIG. 3.
Figure 4B:
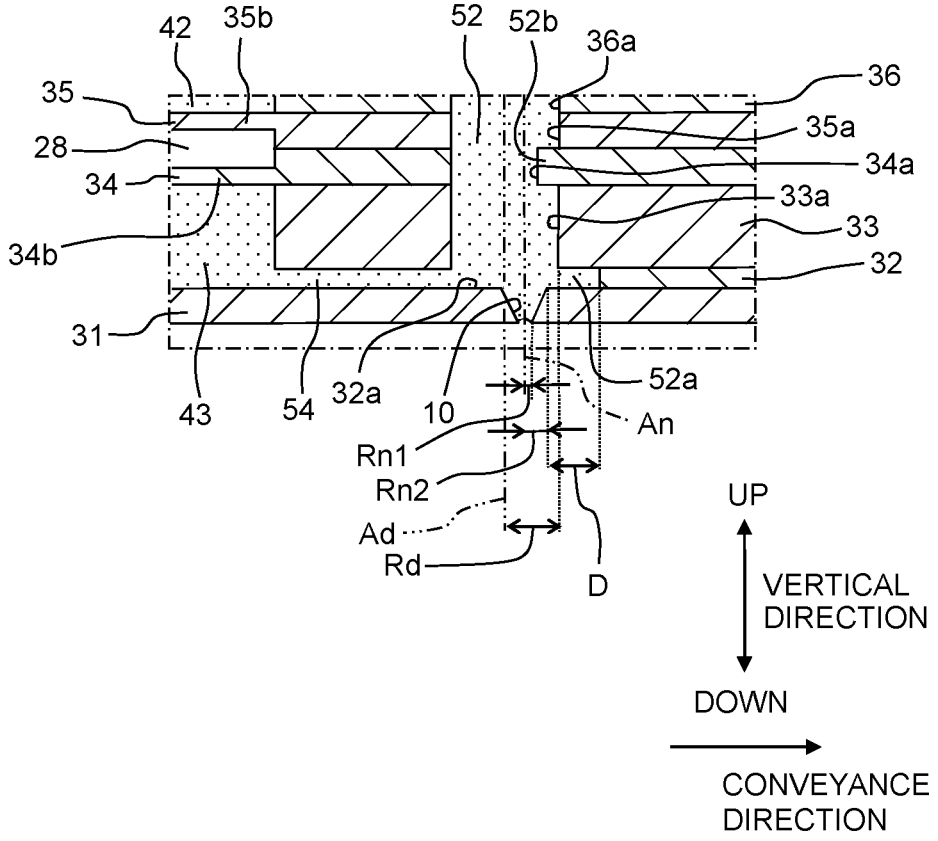
FIG. 4B is an enlarged view of a portion IVB in FIG. 4A.

As depicted in FIG. 4B, a distance in the conveyance direction between a front end of the protruding channel portion 52*a* (an end at one side in the conveyance direction) and the upper end of the nozzle 10 at one side in the conveyance direction (a connecting portion with the descender 52) is referred to as a distance D. The distance D is equal to or more than a length [Rd−Rn2] (e.g., equal to or more than 50 μm) obtained by subtracting the radius Rn2 at the upper end of the nozzle 10 from the radius Rd of the descender 52 (the through holes 33*a* to 38*a*).

A protrusion 52*b* protruding to the other side in the conveyance direction (the second throttle channel 54 side) is formed on an inner wall surface that is included in a portion formed by the through hole 34*a* of the descender 52 and positioned at one side in the conveyance direction. A front end of the protrusion 52*b* is positioned at one side in the conveyance direction with respect to the central axis An of the nozzle 10 (the side opposite to the second throttle channel 54).

The first throttle channel 53 is formed over the plates 37 and 38. More specifically, an end at one side in the conveyance direction of the first throttle channel 53 extends over the plate 38 and an upper portion of the plate 37 in the vertical direction and is connected to an end at the other side in the conveyance direction of the pressure chamber 51. Further, the first throttle channel 53 extends from the connecting portion with the pressure chamber 51 toward the other side in the conveyance direction, and an end at the other side in the conveyance direction of the first throttle channel 53 passes through the plate 38.

The second throttle channel 54 is formed in the plate 32. The second throttle channel 54 is connected to the lower end of the descender 52 at the other side in the conveyance direction. The second throttle channel 54 extends from the connecting portion with the descender 52 toward the other side in the conveyance direction. Thus, in this embodiment, the above-described protruding channel portion 52*a* is formed in a portion of the lower end of the descender 52 at the side opposite to the second throttle channel 54 in the conveyance direction. The protruding channel portion 52*a* protrudes toward the side opposite to the second throttle channel 54 in the conveyance direction beyond any other portion of the descender 52. The protrusion 52*b* is formed on the inner wall surface of the descender 52 at the side opposite to the second throttle channel 54 in the conveyance direction.

Figure 3:
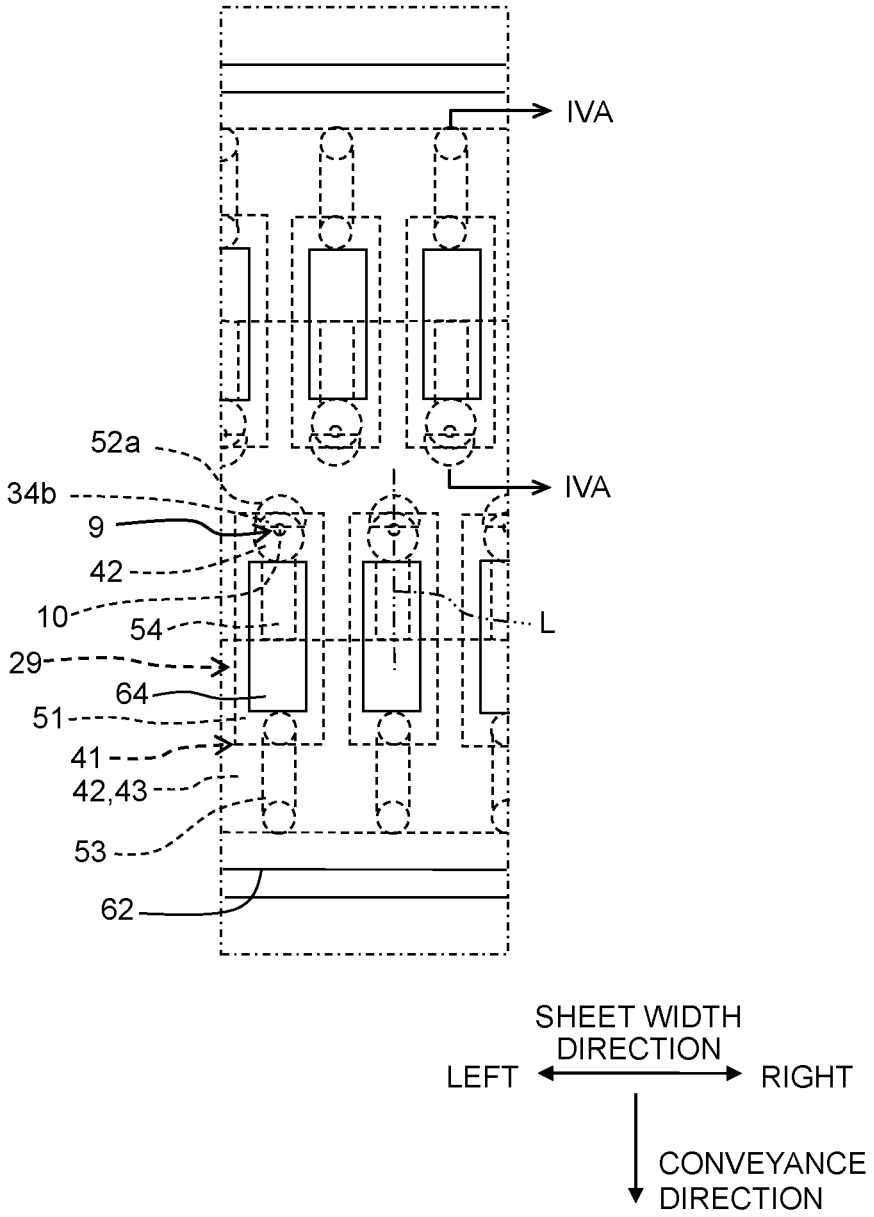
FIG. 3 is an enlarged view of a portion III in FIG. 2.

As depicted in FIG. 3, the center portion of the nozzle 10 and the center portion of the second throttle channel 54 in the sheet width direction are positioned on a straight line L parallel to the conveyance direction. Namely, the position of the center portion of the nozzle 10 is the same as the position of the center portion of the second throttle channel 54 in the sheet width direction.

Corresponding to the configuration in which the nozzles 10 form the two nozzle rows 9, the individual channels 41 form individual channel rows 29 by being arranged in the sheet width direction. The channel unit 21 has two individual channel rows 29 arranged in the conveyance direction.

The two first common channels 42 are formed in the plate 36. The two first common channels 42 correspond to the two individual channel rows 29 and extend in the sheet width direction. Each of the first common channels 42 overlaps in the vertical direction with the first throttle channels 53 and portions at the other side in the conveyance direction of the pressure chambers 51 that form the corresponding individual channel row 29. Each of the first common channels 42 is connected to ends at the other side in the conveyance direction of the first throttle channels 53 of the individual channels 41 forming the corresponding one of the individual channel rows 29.

The two second common channels 43 are formed in the plate 33. The two second common channels 43 correspond to the two individual channel rows 29 and extend in the sheet width direction. The two second common channels 43 overlap in the vertical direction with the two first common channels 42, respectively. Each of the second common channels 43 is connected to ends at the other side in the conveyance direction of the second throttle channels 54 of the individual channels 41 forming the corresponding one of the individual channel rows 29.

Portions of the plates 34 and 35 overlapping in the vertical direction with the first common channel 42 and the second common channel 43 are formed having a damper chamber 28. The damper chamber 28 has a recess that is formed at a portion of a lower surface of the plate 35 overlapping in the vertical direction with the first common channel 42, and a recess that is formed at a portion of an upper surface of the plate 35 overlapping in the vertical direction with the second common channel 43. The damper chamber 28 is formed by overlapping the two recesses. A portion of the plate 35 positioned on the upper side of the damper chamber 28 is a damper 35*b* that is elastically deformed to inhibit the pressure variation of ink in the first common channel 42. Further, a portion of the plate 34 positioned on the lower side of the damper chamber 28 is a damper 34*b* that is elastically deformed to inhibit the pressure variation of ink in the second common channel 43.

The two first common channels 42 extend in the vertical direction at their right ends in the sheet width direction. Each of the two first common channels 42 has the first connecting port 42*a* on an upper surface of the channel unit 31 (plate 39). The two first connection ports 42*a* are connected to an ink tank 59 via tubes (not depicted) or the like. A pump 58*a* is provided in a channel between the two first connection ports 42*a* and the ink tank 59. The pump 58*a* feeds or sends ink from the ink tank 59 toward the two first connection ports 42*a*.

The two second common channels 43 extend in the vertical direction at their left ends in the sheet width direction. Each of the two second common channels 43 has the second connection ports 43*a* on the upper surface of the channel unit 31 (plate 39). The two second connection ports 43*a* are connected to the ink tank 59 via tubes or the like (not depicted). A pump 58*b* is provided in a channel between the two second connection ports 43*a* and the ink tank 59. The pump 58*b* feeds or sends ink from the second connection ports 43*a* toward the ink tank 59.

Driving the pumps 58*a* and 58*b* feeds or sends ink so that ink in the ink tank 59 flows into the first common channels 42 through the first connection ports 42*a*. Ink in the first common channels 42 flows from the first throttle channels 53 to the individual channels 41. Ink in the individual channels 41 flows into the second common channels 43 through the second throttle channels 52. Ink in the second common channels 43 outflows through the second connection ports 43*a* and returns to the ink tank 59. Accordingly, ink circulates between the head unit 6 and the ink tank 59. Only one of the pumps 58*a* and 58*b* may be provided. Also in this case, ink can circulate between the ink tank 59 and the head unit 6 by driving the pump.

The piezoelectric actuator 22 has a vibration plate 61, a piezoelectric layer 62, a common electrode 63, and individual electrodes 64. The vibration plate 61 is formed by a piezoelectric material that includes lead zirconate titanate as a main component. The lead zirconate titanate is a mixed crystal of lead titanate and lead zirconate. The vibration plate 61 is disposed on an upper surface of the channel unit 21 (upper surface of the plate 39) to cover the pressure chambers 51. The piezoelectric layer 62 is formed by the above-described piezoelectric material. The piezoelectric layer 62 is disposed on an upper surface of the vibration plate 61 and extends continuously over the pressure chambers 51. In this embodiment, the vibration plate 61 and the piezoelectric layer 62 are formed by the piezoelectric material. The vibration plate 61 may be formed by any other insulating material than the piezoelectric material, such as a synthetic resin material.

The common electrode 63 is disposed between the vibration plate 61 and the piezoelectric layer 62 to extend over its entire area. The common electrode 63 is connected to a power source (not depicted) and is held at the ground potential. The individual electrodes 64 are disposed on an upper surface of the piezoelectric layer 62. The individual electrodes 64 correspond to the pressure chambers 51 to overlap in the vertical direction with the center portions of the respective pressure chambers 51. The individual electrodes 64 are connected to a driver IC (not depicted). The driver IC selectively applies any of the ground potential and a driving potential (e.g., about 20V) to the individual electrodes 64. Corresponding to the arrangement of the common electrode 63 and the individual electrodes 64 described above, a portion of the piezoelectric layer 62 interposed between the common electrode 63 and each individual electrode 64 is polarized in its thickness direction.

A method of discharging ink from the nozzle 10 by driving the piezoelectric actuator 22 is explained. In the piezoelectric actuator 22, the potential of all the individual electrodes 64 is held at the same ground potential as the common electrode 63 in a standby state in which ink is not discharged from the nozzle 10. When ink is discharged from a certain nozzle 10, the potential of the individual electrode 64 corresponding to the certain nozzle 10 is switched from the ground potential to the driving potential. Then, an electric field in the thickness direction parallel to the polarization direction is generated at the portion of the piezoelectric layer 62 interposed between the individual electrode 64 and the common electrode 63 due to the potential difference between the individual electrode 64 and the common electrode 63. This electric field contracts the portion of the piezoelectric layer 62 in the sheet width direction and the conveyance direction orthogonal to the polarized direction, thus deforming a portion of the vibration plate 61 and the piezoelectric layer 22 overlapping in the vertical direction with the pressure chamber 51 so that the portion becomes convex toward the pressure chamber 51 as a whole. This reduces the volume of the pressure chamber 51 to increase the pressure of the ink in the pressure chamber 51, thereby discharging ink from the nozzle 10 communicating with the pressure chamber 51. After ink is discharged from the nozzle 10, the potential of the individual electrode 64 returns to the ground potential from the driving potential. This makes the piezoelectric layer 62 and the vibration plate 61 return to the state before deformation.

<Effect>

As described above, when ink circulates between the ink tank 59 and the head unit 6, ink flows from the descender 52 extending in the vertical direction to the second throttle channel 54 extending in the horizontal conveyance direction. Here, in order to efficiently discharge air bubbles and the like in the descender 52, the flow rate of the ink flowing from the descender 52 to the second throttle channel 54 is preferably large. However, the large flow rate strengthens the flowing of ink in the conveyance direction at the lower end of the descender 52 (a portion in the vicinity of the nozzle 10). Due to this venturi effect of the flowing of ink in the conveyance direction, ink in the nozzle 10 may be drawn into the descender 52, and a meniscus of ink in the nozzle 10 may be broken. Further, the flowing of ink in the conveyance direction is large at a center portion in the conveyance direction of the descender 52 and a portion at the second throttle channel 54 side with respect to the center portion.

In this embodiment, the center portion in the conveyance direction of the nozzle 10 (central axis An) is positioned at the side opposite to the second throttle channel 54 with respect to the center portion (central axis Ad) of the descender 52. Thus, even when the flow rate of the ink flowing from the descender 52 to the second throttle channel 54 is large, it is possible to reduce the flowing of ink in the conveyance direction at a portion of the descender 52 directly above the nozzle 10. This inhibits a situation in which ink in the nozzle 10 is drawn into the descender 52 due to the venturi effect and the meniscus of ink in the nozzle 10 is broken.

Unlike this embodiment, there may be a configuration in which the descender 52 does not have the protruding channel portion 52*a* when the center portion of the nozzle 10 is positioned on the side opposite to the second throttle channel 54 with respect to the center portion of the descender 52. In this configuration, a distance between the upper end of the nozzle 10 (the connecting portion with the descender 52) at the side opposite to the second throttle channel 54 and the end of the descender 52 at the side opposite to the second throttle channel 54 is short in the conveyance direction. Thus, when the plate 31 is shifted from the plate 32 toward the side opposite to the second throttle channel 54 in the conveyance direction at the time of joining the plate 31 and the plate 32, the nozzle 10 is liable to be blocked by part of the plate 32 corresponding to a wall of the descender 52.

Thus, in this embodiment, the protruding channel portion 52*a*, which extends toward the side opposite to the second throttle channel 54 in the conveyance direction, is provided at the lower end of the descender 52 at the side opposite to the second throttle channel 54 in the conveyance direction. The nozzle 10 is thus not blocked by the portion of the plate 32 corresponding to the wall of the descender 52 even when the plate 31 is slightly shifted from the plate 32 toward the side opposite to the second throttle channel 54 in the conveyance direction at the time of joining the plate 31 and the plate 32.

Figure 5:
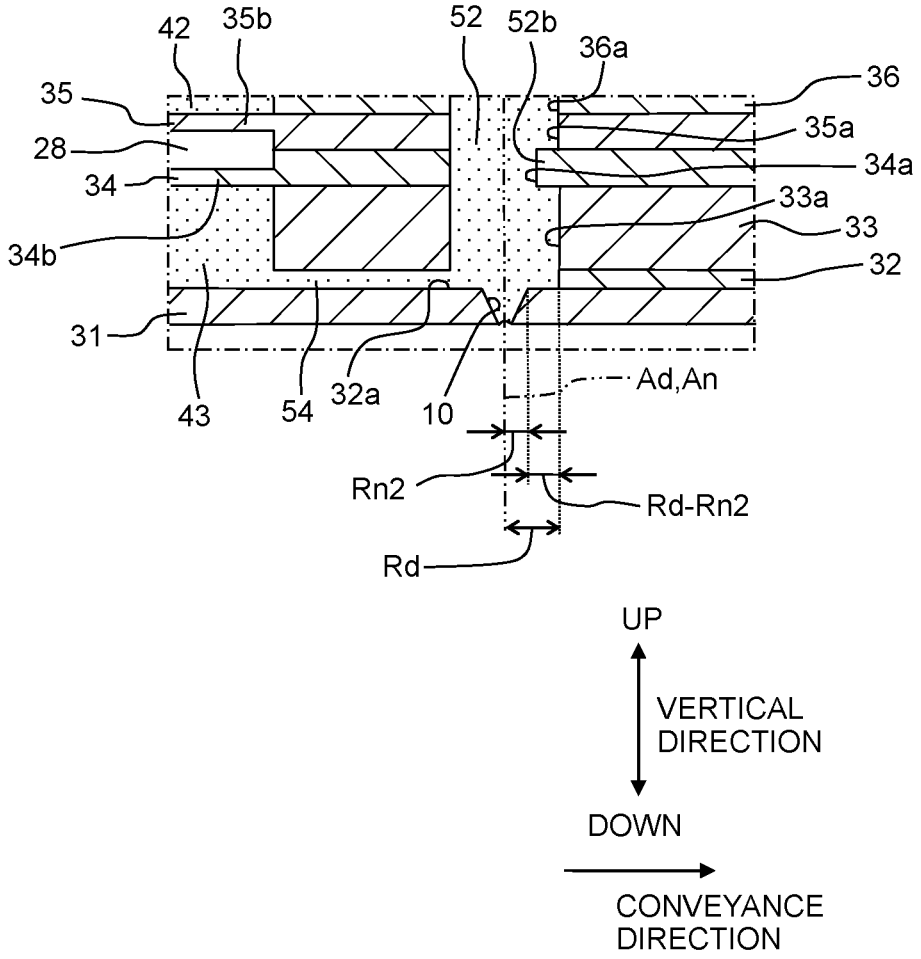
FIG. 5 corresponds to FIG. 4B and illustrates a case where a center portion of a nozzle 10 overlaps with a center portion of a descender 52 and the descender has no protruding channel portion.

It is assumed, unlike this embodiment, that the center portion of the nozzle 10 (central axis An) overlaps in the vertical direction with the center portion of the descender 52 (central axis Ad), as depicted in FIG. 5. In this configuration, the distance between the end of the descender 52 and the upper end of the nozzle 10 (the connecting portion with the descender 52) in the conveyance direction is a length [Rd−Rn2] obtained by subtracting the radius Rn2 at the upper end of the nozzle 10 from the radius Rd of the descender 52. Thus, when the positional shift in the conveyance direction at the time of joining the plate 31 and the plate 32 is equal to or less than [Rd−Rn2], the nozzle 10 is not blocked by the portion of the plate 32 corresponding to the wall of the descender 52.

In this embodiment, the protruding channel portion 52*a* is formed so that the distance D in the conveyance direction between the end of the protruding channel portion 52*a* at the side opposite to the second throttle channel 54 and the upper end of the nozzle 10 at the side opposite to the second throttle channel 54 is equal to or more than the length [Rd−Rn2] obtained by subtracting the radius Rn2 at the upper end of the nozzle 10 from the radius Rd of the descender 52 (the through holes 33*a* to 38*a*). Thus, in this embodiment, the positional shift in the conveyance direction at the time of joining the plate 31 and the plate 32 can be allowed to the same extent as a case where the protruding channel portion 52*a* is not provided and the center portion of the nozzle 10 overlaps in the vertical direction with the center portion of the descender 52.

Also, in this embodiment, the protruding channel portion 52*a* is formed only by the through hole 32*a* included in the through holes 32*a* to 38*a* forming the descender 52. Namely, the protruding channel portion 52*a* is formed in the plate 32 and does not extend to the plate 33. When air bubbles flow into the protruding channel portion 52*a*, air bubbles accumulate at an upper end of the protruding channel portion 52*a*. Thus, the upper end of the protruding channel portion 52*a* is arranged close to the nozzle 10 in the vertical direction. In this configuration, air bubbles accumulated in the protruding channel portion 52*a* are easily discharged by the vibration of meniscus of ink in the nozzle 10, such as when the piezoelectric actuator is driven to discharge ink from the nozzle 10.

In this embodiment, the shortest length of the through holes 32*a* to 38*a* (the diameter of the through holes 33*a* to 38*a* and the length in the sheet width direction of the through hole 32*a*) is about 150 μm, and the thickness of the plates 32 to 38 is equal to or less than 150 μm. Namely, the thickness of the plates 32 to 38 is equal to or less than the shortest length of the through holes 32*a* to 38*a*. It is thus possible to form the through holes 32*a* to 38*a* by etching the plates 32 to 38. In this embodiment, the thickness of the plate 32 is equal to or less than 100 μm, and the shortest length of the through hole 32*a* is longer than 1.5 times the thickness of the plate 32. It is thus possible to form the through hole 32*a* in the plate 32 by etching with particular accuracy.

In this embodiment, the openings of the through holes 33*a* to 38*a* are circular. The opening of the through hole 32*a* is oval or elliptical that is long in the conveyance direction in which the length in the sheet width direction is the same as the through holes 33*a* to 38*a*. In this configuration, the length in the sheet width direction of the opening of the through hole 32*a* is the same as the length in the sheet width direction of the openings of the through holes 33*a* to 38*a*. The length in the conveyance direction of the opening of the through hole 32*a* is longer than the length in the conveyance direction of the openings of the through holes 33*a* to 38*a*. It is thus possible to form the descender 52 having the protruding channel portion 52*a*. Since the length in the sheet width direction of the through hole 32*a* is the same as the length in the sheet width direction of the openings of the through holes 33*a* to 38*a*, the flow rate of ink can be increased by reducing an area of the through hole 32*a* projected in the vertical direction as much as possible.

When the plate 31 and the plate 32 are made from different materials unlike this embodiment, the positional shift in the conveyance direction and the sheet width direction between the nozzle 10 and the descender 52 is easily caused due to the difference in linear expansion coefficients at the time of joining the plate 31 and the plate 32. In this embodiment, since the plate 31 and the plate 32 are made from the same material, the positional shift in the conveyance direction between the nozzle 10 and the descender 52 is not likely to be caused at the time of joining the plate 31 and the plate 32. Further, since the plate 31 in which the nozzles 10 are formed is made from SUS430, the plate 31 is not likely to be damaged even when the recording sheet P comes into contact with the plate 31 during recording on the recording sheet P or the like, and the abrasion resistance of the plate 31 is high.

In this embodiment, the position in the sheet width direction of the center portion of the nozzle 10 is the same as the position in the sheet direction of the center portion of the second throttle channel 54. This increases the flow rate of ink in the vicinity of the nozzle 10 when ink flows from the descender 52 to the second throttle channel 54, thereby efficiently discharging air bubbles in the nozzle 10.

In the descender 52, part of ink flows downward and collides with ink in the nozzle 10 when ink flows from the descender 52 to the second throttle channel 54. This may break the meniscus of ink in the nozzle 10. In order to solve this problem, the descender 52 is provided with the protrusion 52*b* in this embodiment. The protrusion 52*b* inhibits the flowing of ink from the descender 52 toward the nozzle 10, and thus the meniscus of ink in the nozzle 10 is not likely to be broken.

However, when the protruding amount of the protrusion 52*b* is too large, the protrusion 52*b* excessively inhibits the flowing of ink in the descender 52 when the piezoelectric actuator 22 is driven to discharge ink from the nozzle 10. This may cause the failure in ink discharge from the nozzle 10. Thus, in this embodiment, the front end of the protrusion 52*b* is positioned on the side opposite to the second throttle channel 54 in the conveyance direction with respect to the central axis An of the nozzle 10. In this configuration, the protrusion 52*b* does not excessively inhibit the flowing of ink when ink is discharged from the nozzle 10.

Modified Embodiment

The embodiment of the present disclosure is explained above. The present disclosure, however, is not limited to the above embodiment. Various changes or modifications may be made without departing from the claims.

In the above embodiment, the front end of the protrusion 52*b* is positioned at the side opposite to the second throttle channel 54 with respect to the center portion of the nozzle 10 in the conveyance direction. The aspect of the present disclosure, however, is not limited thereto. The front end of the protrusion 52*b* may be at the same position as the center portion of the nozzle 10 in the conveyance direction, or may be positioned at a side closer to the second throttle channel 54 than the center portion of the nozzle 10. Alternatively, the descender 52 may not be provided with the protrusion 52*b*.

In the above embodiment, the position of the center portion of the nozzle 10 is the same as the position of the center portion of the second throttle channel 54 in the sheet width direction. The aspect of the present disclosure, however, is not limited thereto. The position of the center portion of the nozzle 10 may be different from the position of the center portion of the second throttle channel 54 in the sheet width direction.

In the above embodiment, the material of the plate 32, which is joined to the plate 31 formed having the nozzles 10, is the same as that of the plate 31. The aspect of the present disclosure, however, is not limited thereto. For example, only the plate 31 included in the plates 31 to 39 may be formed by a synthetic resin material. Namely, the material of the plate 31 may be different from that of the plate 32.

In the above embodiment, the descender 52 having the protruding channel portion 52*a* is formed by the through holes 33*a* to 38*a* having the circular openings and the through hole 32*a* having the oval or elliptical opening in which the length in the sheet width direction is the same as the through holes 33*a* to 38*a* and the length in the conveyance direction is longer than the through holes 33*a* to 38*a*. The aspect of the present disclosure, however, is not limited thereto. The opening of the through hole 32*a* may have another shape that is longer in the conveyance direction than the openings of the through holes 33*a* to 38*a*. The opening of the through hole 32*a* may be a circle or the like having longer lengths than the through holes 33*a* to 38*a* in the conveyance direction and the sheet width direction.

In the above embodiment, the shortest length of the through hole 32*a* (the length in the sheet width direction of the through hole 32*a*) is about 150 μm, and the thickness of the plate 32 is equal to or less than 100 μm. The aspect of present disclosure, however, is not limited thereto. For example, similar to the plates 33 to 38, the thickness of the plate 32 may be larger than 100 μm as long as the thickness of the plate 32 is equal to or less than 150 μm. Alternatively, the shortest length of the through hole 32*a* may be longer than 150 μm and the thickness of the plate 32 may be larger than 100 μm.

In the above embodiment, the protruding channel portion is formed only by the through hole 32*a* from among the through holes 32*a* to 38*a* forming the descender 52. The aspect of the present disclosure, however, is not limited thereto.

Figure 6:
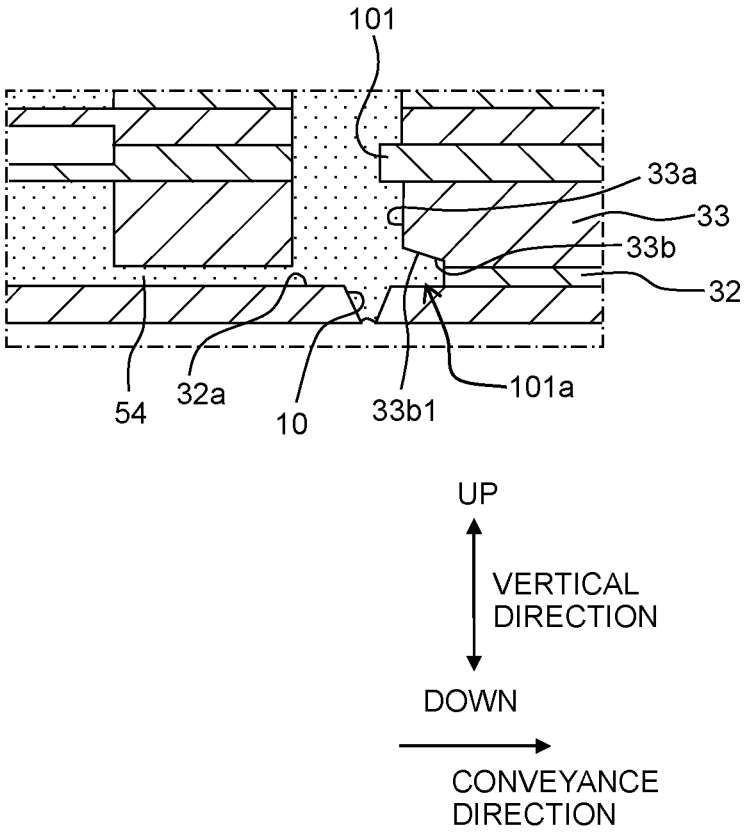
FIG. 6 depicts a modified embodiment and corresponds to FIG. 4B.

For example, in one modified embodiment, a recess 33*b* is formed in a lower surface of the plate 33 in addition to the through hole 33*a* formed in the plate 33, as depicted in FIG. 6. The recess 33*b* is positioned on a side opposite to the second throttle channel 54 in the conveyance direction with respect to the through hole 33*a*. The recess 33*b* is connected to the through hole 33*a* and a portion of the through hole 32*a* that extends toward the side opposite to the second throttle channel 54 in the conveyance direction with respect to the through hole 33*a*. An upper surface 33*b*1 of the recess 33*b* is inclined to the conveyance direction so that a portion closer to the second throttle channel 54 in the conveyance direction is positioned at the upper side. In this modified embodiment, a protruding channel portion 101*a* of a descender 101 is formed by the recess 33*b* and the portion of the through hole 32*a* positioned at the side opposite to the second throttle channel 54 in the conveyance direction with respect to the through hole 33*a*.

In this modified embodiment, an upper surface of the protruding channel portion 101*a* (the upper surface 33*b*1 of the recessed 33*b*) is inclined to the conveyance direction so that a portion closer to the second throttle channel 54 in the conveyance direction is positioned at the upper side. In this configuration, air bubbles flowing into the protruding channel portion 101*a* are easily discharged by being guided by the upper surface 33*b*1, which inhibits air bubbles from accumulating at the protruding channel portion 101*a*.

In the above modified embodiment, the upper surface of the protruding channel portion 101*a* (the upper surface 33*b*1 of the recess 33*b*) is an inclined surface that is inclined to the conveyance direction. The aspect of the present disclosure, however, is not limited thereto. In a case where the protruding channel portion extends over two or more plates as in the above modified embodiment, the upper surface of the protruding channel portion may be a surface parallel to the conveyance direction.

For example, it is assumed that the protruding channel portion is formed only by the plate 32. In this case, a circular through hole that is part of the descender may be formed in the plate 32; a recess that is the protruding channel portion and is connected to the circular through hole may be formed at a portion of the lower surface of the plate 32 at the side opposite to the second throttle channel 54 in the conveyance direction; and an upper wall surface of the recess may be an inclined surface that is inclined to the conveyance direction so that a portion closer to the second throttle channel 54 in the conveyance direction is positioned at the upper side.

In the above embodiment, the distance D in the conveyance direction between the front end of the protruding channel portion 52*a* and the upper end of the nozzle 10 at the side opposite to the second throttle channel 54 is equal to or more than the length [Rd−Rn2] obtained by subtracting the radius Rn2 at the upper end of the nozzle 10 from the radius Rd of the descender 52. The aspect of the present disclosure, however, is not limited thereto. The distance D may be less than the length [Rd−Rn2]. In this case, since the descender has the protruding channel portion, the nozzle 10 is less likely to be blocked by the positional shift at the time of joining the plate 31 and the plate 32 than a case where no protruding channel portion is provided.

In the above embodiment, when ink circulates between the ink tank 59 and the head unit 6, ink flows from the first throttle channels 53 to the individual channels 41, and ink in the individual channels 41 outflows through the second throttle channels 54. The aspect of the present disclosure, however, is not limited thereto. The direction in which ink is fed or sent by the pumps 58*a* and 58*b* may be reversed from the above embodiment, whereby the flowing of ink when ink circulates between the ink tank 59 and the head unit 6 may be reversed from the above embodiment.

In the above embodiment, the first common channels 42 overlap in the vertical direction with the second common channels 43. The aspect of the present disclosure, however, is not limited thereto. The positional relationship between the first common channels 42 and the second common channels 43 may be different from the above embodiment, such as a positional relationship in which the first common channel 42 and the second common channel 43 are arranged in the conveyance direction.

In the embodiment and the modified embodiment, the examples in which the present disclosure is applied to the ink-jet head that discharges ink from nozzles, are explained. The aspect of the present disclosure, however, is not limited thereto. The present disclosure is applicable to a liquid discharge head that is different from the ink-jet head and is configured to discharge any other liquid than ink.

What is claimed is:

1. A liquid discharge head, comprising:

a channel unit including: a plurality of plates stacked in a first direction, wherein a plurality of individual channels, a first common channel communicating with the individual channels, and a second common channel communicating with the individual channels are formed in the channel unit, wherein each of the individual channels includes:

a nozzle;

a pressure chamber disposed away from the nozzle in the first direction and overlapping with the nozzle in the first direction;

a descender extending in the first direction and connecting the nozzle and the pressure chamber;

a first throttle channel connecting the pressure chamber and the first common channel; and a second throttle channel extending in a second direction orthogonal to the first direction and connecting the second common channel and an end of the descender at a side of the nozzle in the first direction, wherein the plates include:

a nozzle plate in which the nozzle is opened;

a pressure chamber plate in which the pressure chamber is formed; and a first plate which is joined to a surface of the nozzle plate at a side of the pressure chamber plate in the first direction and in which a first through hole that constitutes part of the descender is formed, wherein a center portion of the nozzle is positioned at a side opposite to the second throttle channel in the second direction with respect to a center portion of the descender, wherein the descender includes a protruding channel portion that is formed in the first plate, is positioned at an end at the side opposite to the second throttle channel in the second direction, and protrudes toward the side opposite to the second throttle channel beyond any other portion of the descender, and wherein a shortest length of an opening of the first through hole is equal to or less than 150 μm, and the first plate has a thickness of equal to or less than 100 μm.

2. The liquid discharge head according to claim 1, wherein a distance in the second direction between an end of the protruding channel portion at the side opposite to the second throttle channel and an end of a connection portion of the nozzle with the descender at the side opposite to the second throttle channel is equal to or more than a length obtained by subtracting a radius at the connection portion of the nozzle with the descender from a radius of the descender.

3. The liquid discharge head according to claim 2, wherein the distance in the second direction between the end of the protruding channel portion at the side opposite to the second throttle channel and the end of the connection portion of the nozzle with the descender at the side opposite to the second throttle channel is equal to or more than 50 μm.

4. The liquid discharge head according to claim 2, wherein the radius at the connection portion of the nozzle with the descender is equal to or less than 25 μm.

5. The liquid discharge head according to claim 1, wherein the first direction is parallel to a vertical direction, and an upper inner wall surface of the protruding channel portion is inclined to the second direction so that a portion closer to the second throttle channel in the second direction is positioned at the upper side.

6. The liquid discharge head according to claim 1, wherein the plates further include a second plate which is joined to a surface of the first plate at a side opposite to the nozzle plate in the first direction and in which a second through hole that constitutes part of the descender is formed, and the protruding channel portion does not extend to the second plate.

7. The liquid discharge head according to claim 1, wherein the plates further include a second plate which is joined to a surface of the first plate at a side opposite to the nozzle plate in the first direction and in which a second through hole that constitutes part of the descender is formed, wherein the first through hole is longer in the second direction than the second through hole, and extends beyond the second through hole toward the side opposite to the second throttle channel in the second direction, wherein a portion extending beyond the second through hole toward the side opposite to the second throttle channel is the protruding channel portion, and wherein a length in a third direction, that is orthogonal to the first direction and the second direction, of the first through hole is identical to a length in the third direction of the second through hole.

8. The liquid discharge head according to claim 7, wherein an opening of the second through hole is circular, and wherein an opening of the first through hole is oval or elliptical of which longitudinal direction is parallel to the second direction.

9. The liquid discharge head according to claim 1, wherein a material of the nozzle plate is identical to a material of the first plate.

10. The liquid discharge head according to claim 1, wherein a position in a third direction, that is orthogonal to the first direction and the second direction, of the center portion of the nozzle is identical to a position in the third direction of a center portion of the second throttle channel.

11. The liquid discharge head according to claim 1, further comprising a pump configured to send or feed a liquid so that the liquid flows from the first common channel to the pressure chamber via the first throttle channel and then the liquid flows from the descender to the second common channel via the second throttle channel, wherein a protrusion extending toward the second throttle channel in the second direction is located at a portion, of an inner wall surface of the descender at the side opposite to the second throttle channel in the second direction, positioned between the protruding channel portion and the pressure chamber in the first direction.

12. The liquid discharge head according to claim 11, wherein a front end in the second direction of the protrusion is positioned at the side opposite to the second throttle channel in the second direction with respect to a central axis of the descender.

* * * * *